US006332992B1

(12) United States Patent
Chatelain

(10) Patent No.: US 6,332,992 B1
(45) Date of Patent: Dec. 25, 2001

(54) PROCESS FOR MAKING COMPOSITE BUILDING PANELS

(76) Inventor: Paul J. Chatelain, 16009 Amber Valley, Whittier, CA (US) 90604

( * ) Notice: Subject to any disclaimer, the term of this patent is extended or adjusted under 35 U.S.C. 154(b) by 0 days.

(21) Appl. No.: 09/395,281

(22) Filed: Sep. 13, 1999

Related U.S. Application Data

(62) Division of application No. 08/980,570, filed on Dec. 1, 1997, now Pat. No. 5,966,885.

(51) Int. Cl.[7] ..... B28B 1/08; B27N 3/10

(52) U.S. Cl. ..... 264/69; 264/257

(58) Field of Search ..... 264/69, 257; 427/346, 427/430.1, 434.2, 434.7, 443.2; 156/73.6, 250, 270, 325

(56) References Cited

U.S. PATENT DOCUMENTS

| | | | | |
|---|---|---|---|---|
| 3,908,044 | * | 9/1975 | Gunning | 427/209 |
| 4,203,788 | * | 5/1980 | Clear | 156/44 |
| 4,259,379 | * | 3/1981 | Britton et al. | 427/356 |
| 4,816,091 | * | 3/1989 | Miller | 156/42 |

* cited by examiner

*Primary Examiner*—Christopher A. Fiorilla
(74) *Attorney, Agent, or Firm*—Edgar W. Averill, Jr.

(57) ABSTRACT

A process for coating an upper surface of a panel with a mesh reinforced coating includes the steps of: placing a cementitious mixture in a container having a measured slit in the bottom thereof; passing a length of mesh through the container to produce a cementitious laden mesh; moving said panel and container with respect to each other while laying said cementitious laden mesh onto the upper surface of the panel; and cutting off the mesh to provide a coated panel. The coated panel may be subjected to vibration to smooth the upper surface thereof.

3 Claims, 5 Drawing Sheets

FIG.11.

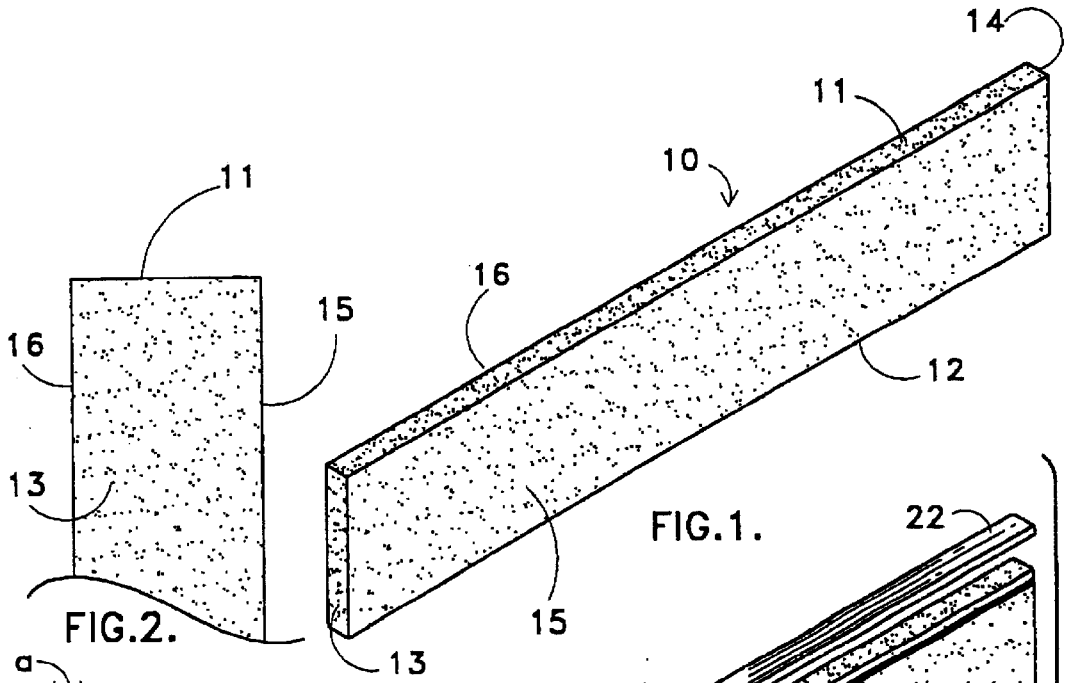
FIG.1.
FIG.2.
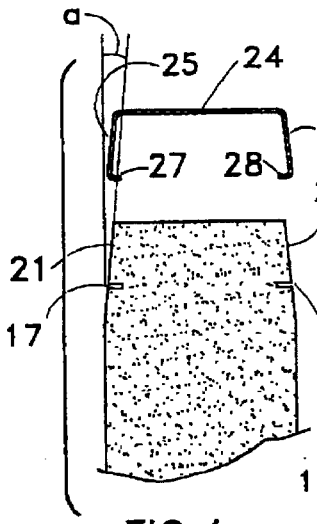
FIG.4.
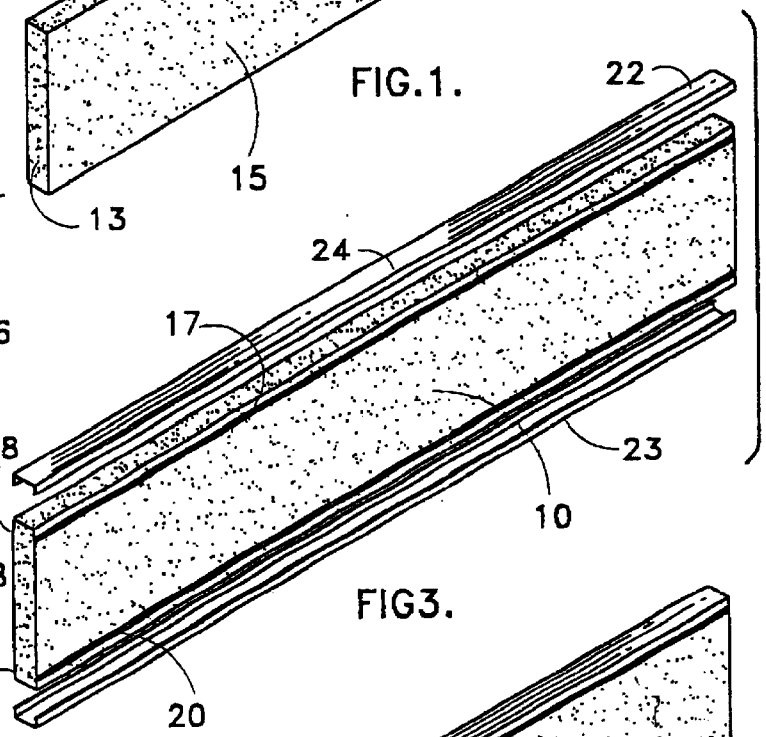
FIG3.
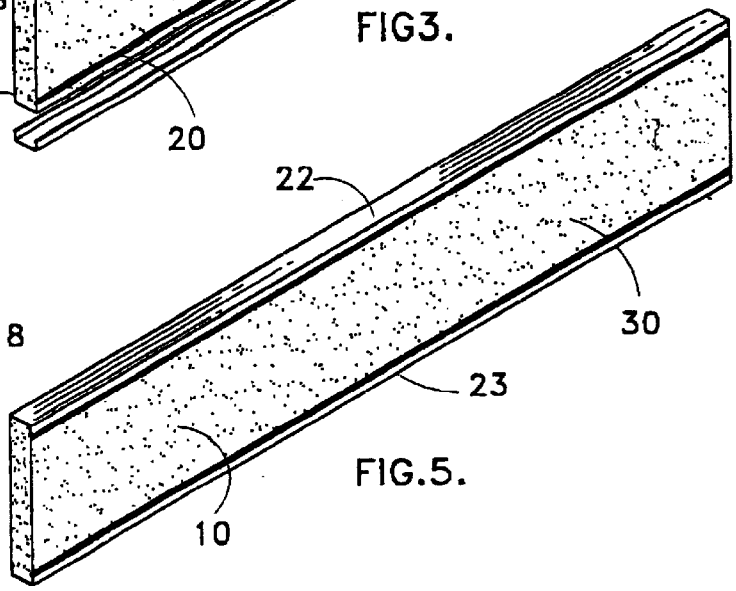
FIG.5.
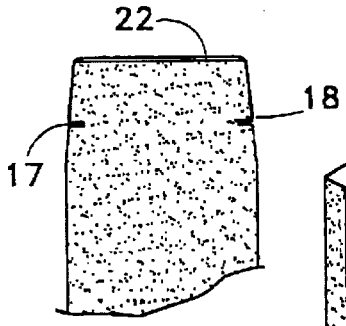
FIG.6.

FIG.11.
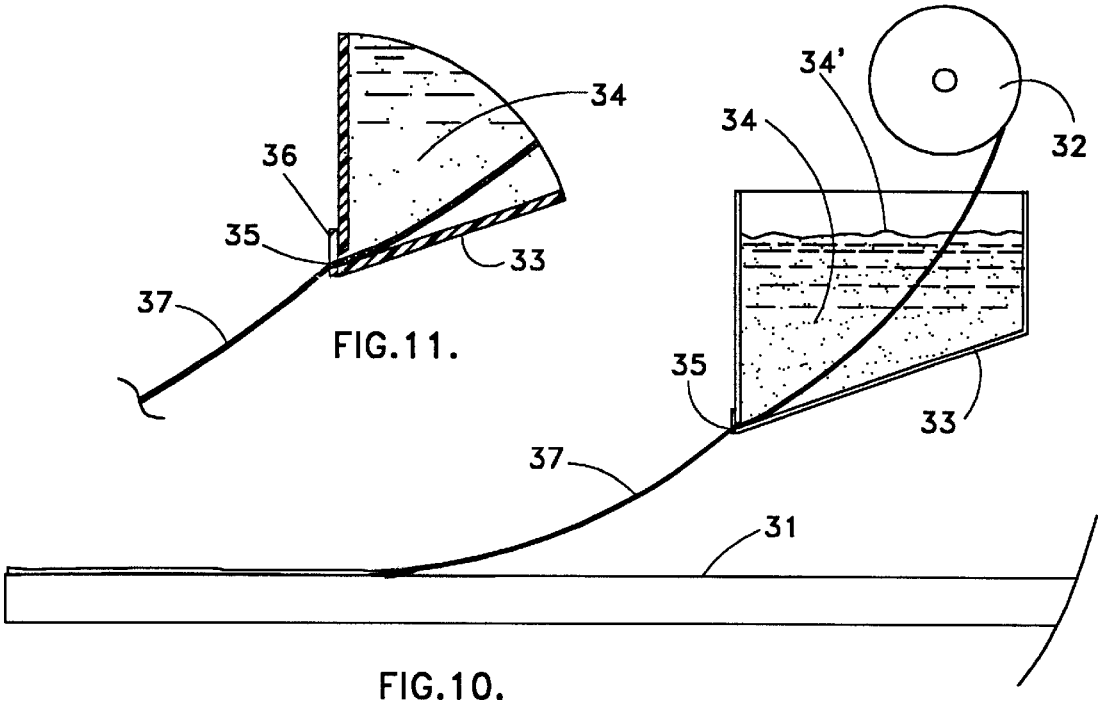
FIG.10.
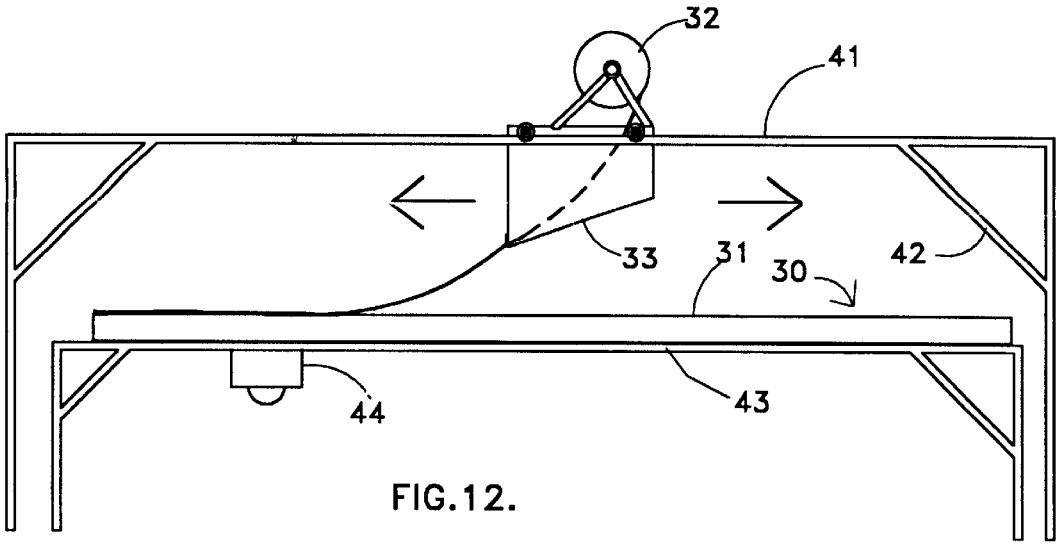
FIG.12.

PROCESS FOR MAKING COMPOSITE BUILDING PANELS

CROSS-REFERENCE TO RELATED APPLICATIONS

This application is a divisional application of application Ser. No. 08/980,570 filed Dec. 1, 1997, now U.S. Pat. No. 5,966,885.

BACKGROUND OF THE INVENTION

The field of the invention is building materials and the invention relates more particularly to the building of walls or fences. Perhaps the most common wall is built from cement block which requires a substantial foundation to be dug below the wall and filled with concrete to support the weight of the cement blocks. The cement blocks must be placed by a professional mason or a skilled amateur to provide a wall that has an attractive appearance. In spite of the use of foundations, such walls frequently settle in parts and form a "stairstep" crack along the joints between adjacent blocks. Such block walls are commonly covered with a layer of stucco and this crack is visible on the exterior of the stucco. This is an especially common problem with clay soils which tend to expand when wet and contract when dried.

Other common types of fences include grape stake fences or fences made with vertical slats which are nailed to rails. Unfortunately, wood has become a scarcer and more expensive commodity. Whereas original growth redwood had excellent weathering characteristics, newer redwood does not have this same ability. Thus, when such fences are built utilizing wooden posts, such posts rather quickly rot or are eaten by termites and need to be replaced in less than 10 years. Chain link fences are very widely used but have an industrial look which is unacceptable for most residential or office developments.

Various approaches have been taken to provide walls which overcome some of the problems mentioned above. The present invention also contemplates an efficient process for coating the exterior surfaces of a foam panel and various approaches have been taken for such coating processes. For instance, U.S. Pat. No. 4,303,722 shows a process for adhering glass fibre tissue to a panel. This is accomplished by passing a tissue through a pair of rollers which impregnate the tissue with adhesive. A moving belt of release material is used to press the adhesive coated tissue onto the surfaces of the foam.

A process for making plasterboard is shown in U.S. Pat. No. 4,364,790 where a roll of reinforcing material such as paper, cardboard, metallic film, aluminum sheet, glass, cloth, etc. is placed within a layer of plaster by various methods to form a reinforced plasterboard. In U.S. Pat. No. 4,488,917, cement board is made by spreading mortar over fiber scrim in a continuous manner.

Various wall constructions are disclosed in the prior art. A noise barrier is shown in U.S. Pat. No. 4,566,558. Posts made of channel material hold panels 12. The panels include a foam portion into which various channels are embedded. The foam is covered with plastic facing and chambers are provided to hold a sound absorption material.

A wall utilizing a polystyrene bead board core having a thin concrete facing reinforced with a fiberglass open weave mesh is shown in U.S. Pat. No. 4,578,915. Vertical steel studs hold gypsum wallboard 14 on an inner surface. On the outer surface, foam panels have been coated with a fiberglass mesh which contains a thin fiberglass mesh. After the panels have been screwed to the steel studs, the joints are taped and the entire assembly is coated with a Portland Cement exterior coating.

A sound barrier fence is shown in U.S. Pat. No. 4,674,593. This sound barrier uses concrete posts which are formed with grooves. Cement panels are placed in the grooves and the space between the cement panels is filled with a foam. U.S. Pat. No. 4,899,498 is another highway sound barrier. The wall panels are made from a foamed material which is covered with a fiberglass reinforced cement composition. The panels are anchored to the ground by a helical screw anchor rod embedded in a concrete pad. U.S. Pat. No. 4,961,298 shows a prefabricated exterior panel system which also uses a plastic foam board reinforced along one surface by spaced-apart reinforcing members, such as aluminum channels. Grooves are cut into the panel and the reinforcing members are held in the grooves by an adhesive.

U.S. Pat. No. 5,129,628 shows a fence wall construction which has reinforcing flanges concealed within the plastic foam body. Lastly, U.S. Pat. No. 5,404,685 shows a foam plastic wall covered with an exterior mesh stucco coating. The panels are held in grooves in adjacent posts. The styrofoam panels are coated after they have been placed between adjacent posts.

Numerous approaches have been tried to make walls out of foam panels covered with reinforced cement. Such approaches have the advantage of a lightweight panel which nonetheless has an exterior coating which is not only strong but is fire and insect proof. The foam panels themselves are relatively weak and can be easily bent. They, thus, must be supported by some sort of substrate before being coated with a reinforced cementitious material. The coating process requires skill and, thus, the form on the jobsite must be done by skilled labor.

BRIEF SUMMARY OF THE INVENTION

It is an object of the present invention to provide a panel which may be made at a manufacturing location so that it is straight and coated with a reinforced cementitious type of coating when it is purchased by the end user. It is another object of the present invention to provide a set of panels which may be combined and attached together in such a way that the finished wall or fence is easily made smooth.

It is a further object of the present invention to provide a process for fabricating a panel with structural strength which may be easily used by inexperienced persons to build a wall with a highly professional appearance.

The present invention is for a panel for use in the construction of walls. The panel has a generally rectangular core which is made from a polymeric foam. The foam panel is elongated. A typical panel having a height of 2' and a length of 10' so that it may be easily carried by the end user. The panel has a pair of grooves formed in the faces adjacent the top and bottom edges and a metal C-shaped reinforcing channel is held in these grooves along the top and bottom edges of the foam panel to hold the panel in a straight configuration. Preferably, the top and bottom edges of the panel are beveled so that when one panel is placed on top of another panel, a shallow trough is formed which may be later easily filled to form a smooth surface.

The process for forming the panel of the present invention includes passing a woven mesh of reinforcing fiberglass through a cementitious tub. This fills the pores in the mesh with the cementitious material which is then pulled out of the bottom of the tub through a measured slit, thereby causing the mesh to carry the cementitious material in its interstices. The cement laden mesh is then placed along the upper surface of a panel. The panel is then vibrated to remove any air and smooth out the upper surface of the cementitious material capturing the reinforcing mesh which is then allowed to cure on the upper surface of the panel.

The process for building a smooth surface panel fence includes the steps of placing vertical fence posts in the ground spaced apart a distance no longer than that of the length of the panels used to build the fence. The posts are provided with channels into which the panels may be slid. After the panels have been slid into the posts, a shallow trough is formed at the intersection of adjacent panels which is then filled with a reinforced cementitious material to provide a smooth surface. Lastly, the entire fence is covered with a stucco-like coating to provide a smooth fence which does not require any continuous footing.

BRIEF DESCRIPTION OF THE DRAWINGS

FIG. 1 is a perspective view showing a foam panel.

FIG. 2 is an enlarged end view of the panel of FIG. 1.

FIG. 3 is a perspective view of the panel of FIG. 1 modified by adding grooves by beveling the top edges and showing a pair of reinforcing channels above and below the panel.

FIG. 4 is an enlarged end view of the panel and reinforcing channel of FIG. 3.

FIG. 5 is a perspective view of the panel of FIG. 3, except that the channels have been attached into the grooves of the panel.

FIG. 6 is an enlarged end view of the top of the panel of FIG. 5.

FIG. 10 is a side view partly in cross-section of the coating process of FIG. 8 showing the interior of the coating tank.

FIG. 11 is an enlarged cross-sectional view of the portion of the tank and mesh of FIG. 10.

FIG. 12 is a side view showing the frame which holds the panel and coating apparatus of FIG. 10.

DESCRIPTION OF THE PREFERRED EMBODIMENTS

Figure 7:
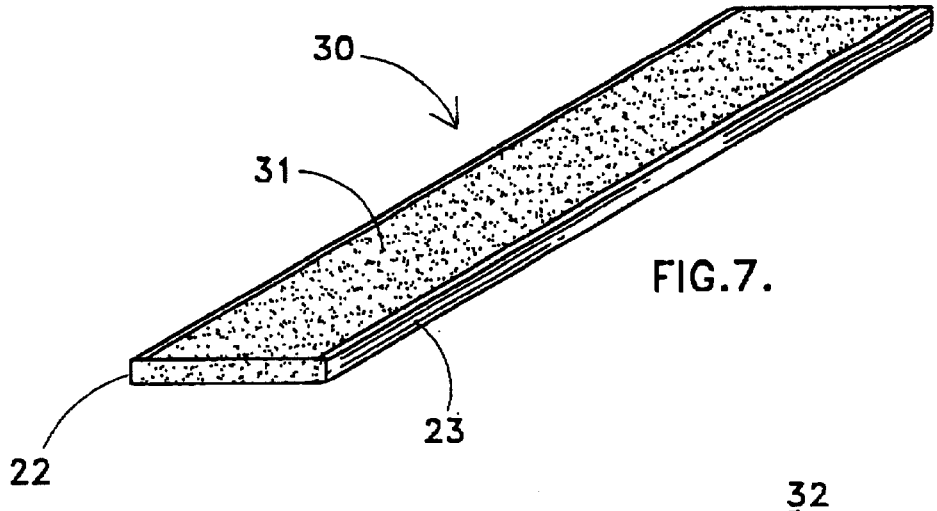
FIG. 7 is a view of the panel of FIG. 5 shown with its upper surface in a generally horizontal configuration.

A styrofoam panel is shown in perspective view in FIG. 1 and indicated generally by reference character 10. Panel 10 has a top 11, a bottom 12, a first end 13, a second end 14, a first face 15, and a second face 16. The panel is preferably about 2' high, 10' long and 3 ⅝ thick. Needless to say, the panel is very light and can be easily lifted by one person. The top corner of panel 10 is shown in FIG. 2 prior to any shaping steps.

Panel 10 is shown in a shaped configuration in FIG. 3. As shown best in FIG. 4, panel 10 has a pair of grooves 17 and 18 formed near top 11. A similar pair of grooves 19 and 20 are formed near bottom 12. A shallow beveled portion is formed on both sides adjacent top 11 and bottom 12 and indicated by reference character 21. This bevel can be of a relatively small angle, such as 5°, and the angle is indicated by the reference character "a" in FIG. 4. This angle forms an important part of the present invention and permits adjacent panels to be joined in a smooth and attractive manner as described below.

Another important feature of the present invention is the pair of reinforcing channels 22 and 23. Each channel has a flat face 24, two generally flat sides 25 and 26, and a pair of inwardly depending portions 27 and 28. Channels 22 and 23 should be formed from a material of sufficient strength to hold the somewhat flexible foam panel 10 in a straight configuration. One material that has been found sufficient for this purpose is 25 gauge galvanized iron sheet bent into the shape shown in FIGS. 3 and 4. Other strong materials, such as glass reinforced nylon or other composite materials can, of course, be used. The important feature is a separate piece which may be snapped over or slid onto the top and bottom of the foam panel and held in a straight configuration.

The assembled uncoated panel is shown in FIGS. 5 and 6 and indicated by reference character 30.

Figure 8:
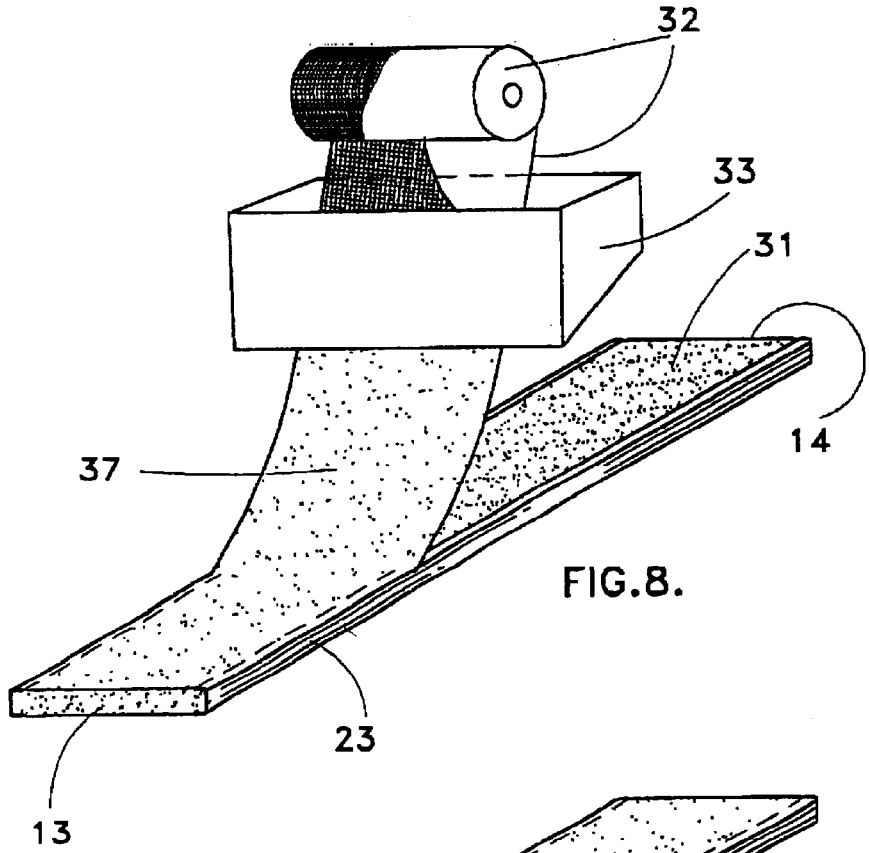
FIG. 8 is a perspective view of the panel of FIG. 7 in the process of being coated with a fiberglass mesh reinforced cementitious material.
Figure 9:
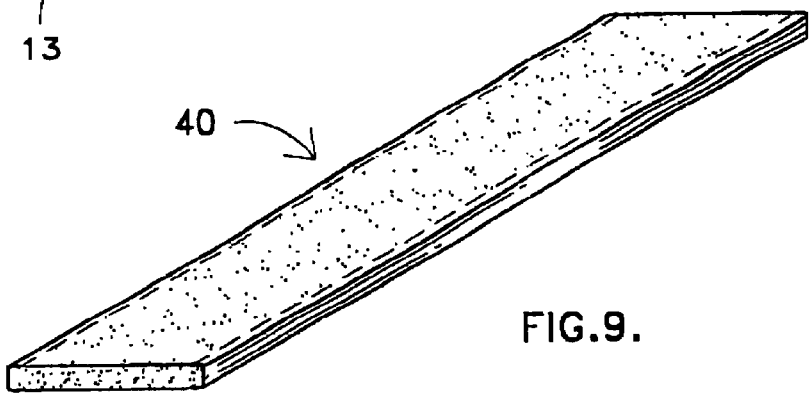
FIG. 9 is a perspective view of the panel of FIG. 7 with a coating of mesh reinforced cementitious material.

The next step in forming a panel capable of constructing a strong and durable wall or fence is shown in FIGS. 8 and 9. The assembled uncoated panel 30 is shown in FIG. 7 with its upper surface 31 in a generally horizontal configuration. In FIG. 8 a roll of reinforcing mesh is shown supported above a container 33 which contains a cementitious material of the type typically referred to as "dry bond." This material is reinforced with an acrylic polymer so that it is exceptionally strong and able to withstand cracking. The reinforced mesh 32 is pulled through the upper surface 34' and through the moistened dry bond 34 (shown best in FIG. 10). As the open mesh 32 passes through the cementitious material 34, it is soaked with the cementitious material. The mesh exits container 33 through a slit 35 shown best in FIG. 11. This slit 35 is formed in a metal bar or between a pair of bars which may be adjusted and squeezes out any additional cementitious material 34 to provide a cement laden mesh 37. This carries the coating and reinforcement materials onto the upper surface 31 of assembled uncoated panel 30. When the cement laden mesh 37 reaches the end 14 it is cut and a new panel may then be coated.

A coated panel 40 is shown in FIG. 9 and this panel has a reinforced cementitious coating on both sides thereof. Needless to say, after one side of the panel is coated as shown in FIG. 8 it is permitted to cure. It is then turned over and the second side is coated. The finished coated panel is indicated by reference character 40. During the coating process, as shown best in FIG. 12, it is advantageous for the container 33 filled with cementitious material 34 and the roll of reinforced mesh to be rolled along a pair of tracks 41 on a frame 42. The panel 30 being coated rests on a table 43 which is supported on the ground. Table 43 is preferably equipped with a vibrator 44. Vibrator 44 is briefly energized after the cement laden mesh has completely covered the upper surface 31 of panel 30. This greatly smooths the cementitious material and removes any air or imperfections and drives this material into the open cells of the foam surface. The outer surface of the thus smoothed cementitious material may then be slightly roughened, if desired, to facilitate the later coating with stucco. This may be done with a broom or other object after the vibration step. In addition one or more additional layers of open mesh and cementitious material may further be added over the first layer for additional strength. Three layers on each side make an exceptionally strone panel.

The method of building a fence or wall is shown best in FIGS. 13 through 19. Preferably cement posts made according to applicant's co-pending application, Ser. No. 08/521,282 filed Aug. 30, 1995, are placed at intervals so that there is no more than a 10' space between adjacent posts. As shown best in FIG. 19, a pair of channels 50 and 51 are held against faces 52 and 53 of cement post 54. The channels 50 and 51 are held against the faces by a nut and bolt indicated generally by reference character 55. These channels are preferably made from galvanized iron of 25 gauge, similar to channels 22 and 23.

Figure 13:
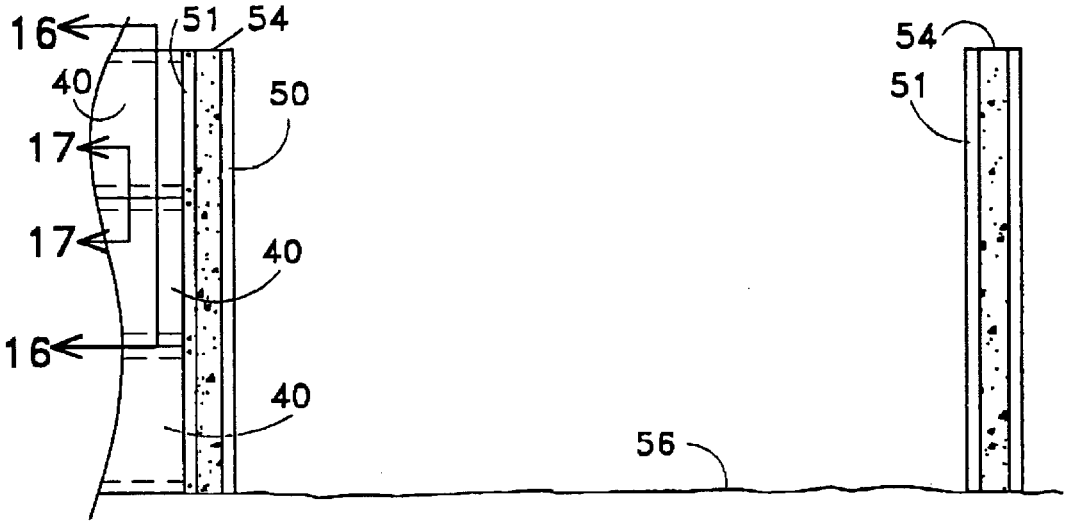
FIG. 13 is a front view of a fence under construction showing portions of three panels of FIG. 9 and a pair of fence posts.
Figure 14:
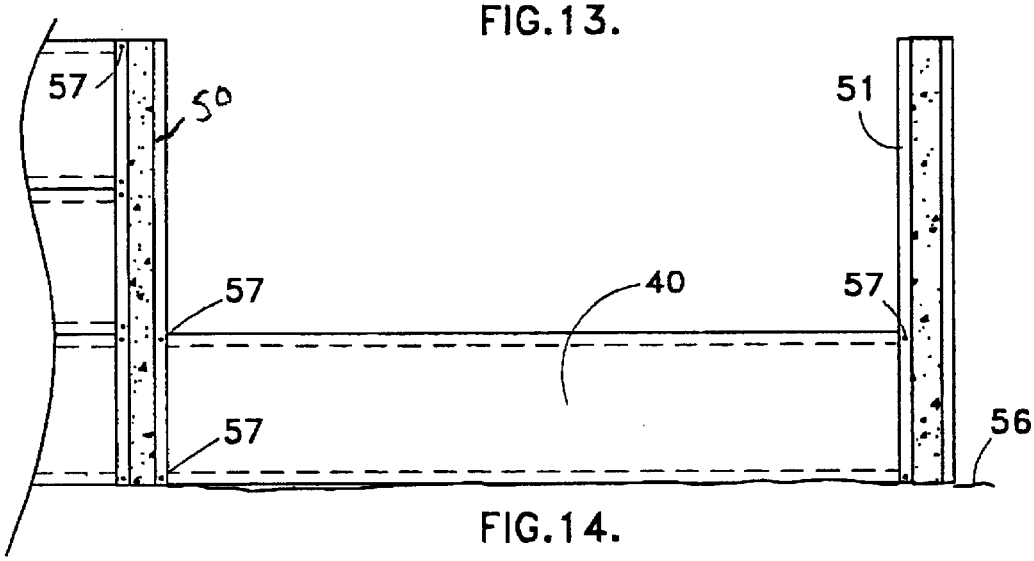
FIG. 14 is a front view analogous to FIG. 13, except that one panel has been placed between the two adjacent posts.
Figure 15:
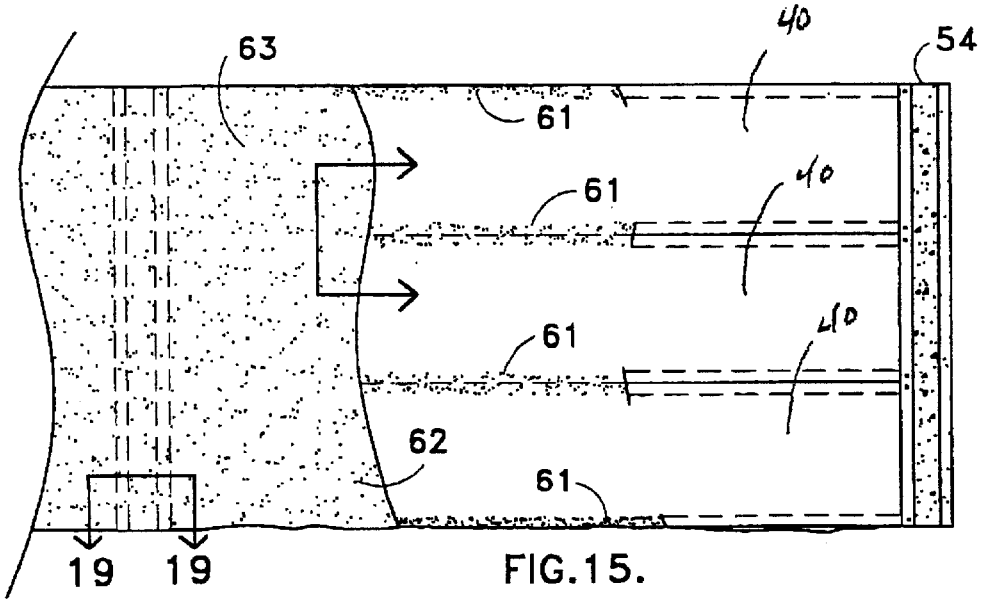
FIG. 15 is a front view analogous to FIG. 14 showing three of the panels of FIG. 9 at three states, one being ungrouted, one being grouted, and one being grouted and covered with stucco.
Figure 17:
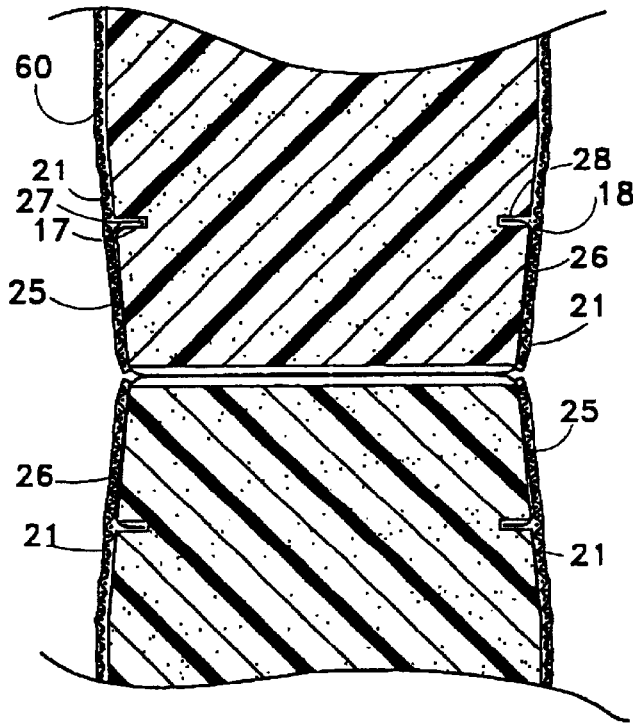
FIG. 17 is a cross-sectional view taken along line 17—17 of FIG. 13.
Figure 18:
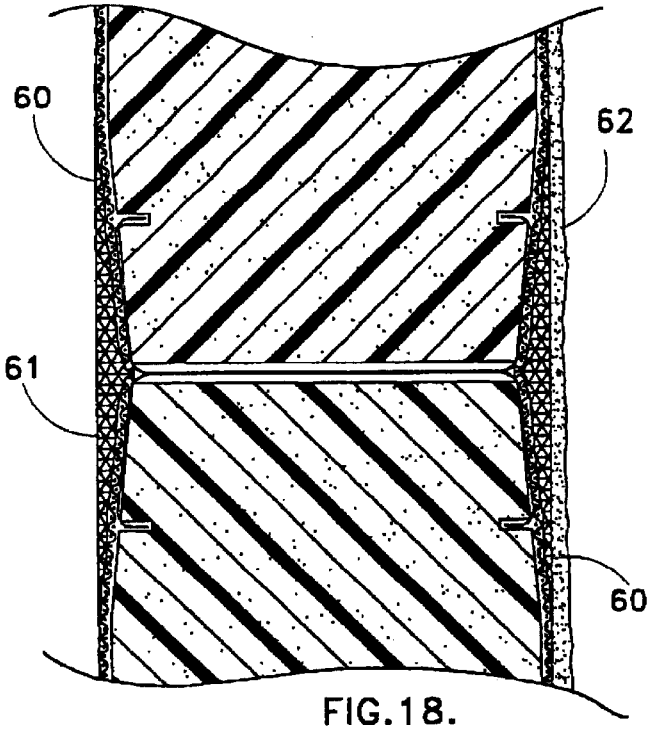
FIG. 18 is a cross-sectional view taken along line 18—18 of FIG. 15.

Returning to FIG. 14, three coated panels 40 have been inserted between adjacent posts, only one of which is shown in FIG. 13, and slid into channel 51. It is often preferable to space the posts slightly less than 10' and to cut the panels to length before inserting. The panels may be easily cut with a carborundum blade. Next, a new coated panel is slid downwardly from the top of channels 50 and 51 until it touches ground 56. Once the panels are leveled, they are preferably screwed with sheet metal screws through the vertical channels attached to the post, such as channel 50, into the horizontal channels attached to the panels, such as channel 22. In the case of a 6' high fence, three 2' high panels are put in place as shown in FIG. 15. As the panels are initially placed in channels 50 and 51, they abut together as shown in FIG. 17. Because of the bevel 21 a shallow depression or trough is formed which is shown unfilled in FIG. 17 and filled in FIG. 18. The formerly cement laden mesh 37 has cured into a reinforced cement coating 60 which covers not only the faces of the foam, but also covers the sides 25 and 26 of the reinforcing channels, such as channels 22 and 23.

Figure 16:
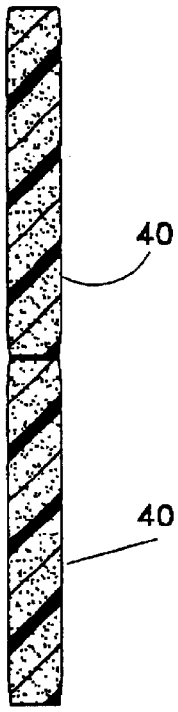
FIG. 16 is a cross-sectional view taken along line 16—16 of FIG. 13.

Two adjacent channels are shown in FIG. 16 in a typical proportion of height and width. Even when the panels are coated with the reinforced cementitious material they are easy to lift and slide into the channels attached to the post.

Figure 19:
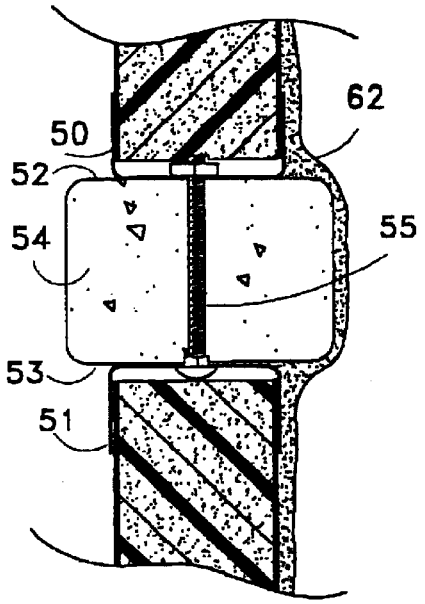
FIG. 19 is a cross-sectional view taken along line 19—19 of FIG. 15.

Next, a grouting material 61 is placed in the shallow trough formed by bevels 21. Grouting material 61 is preferably reinforced either by a reinforcing tape or by reinforcing fibers in the grouting material. This is easily leveled with a putty knife to form a flat surface. Lastly, as shown in the righthand portion of FIG. 18, a layer of stucco 62 is placed over the faces of the panels. Stucco 62 is preferably also placed over the cement post 54 as shown in FIG. 19. The finished fence is shown in the lefthand portion of FIG. 15 and indicated generally by reference character 63. The fence or wall is economically constructed because it can be done quickly by relatively unskilled laborers without the necessity of building a footing. Because the fence is constructed of very lightweight materials, it can withstand a substantial earthquake shock. If it happens to be struck with a car, the fence can be readily repaired.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A process for coating an upper surface of a panel with a mesh reinforced coating comprising the steps of:

placing a thick cementitious mixture in a container having a measured slit in the bottom thereof and an opening for the feeding of a length of mesh;

placing a source of mesh so that a length of the mesh can be fed into said container;

placing a panel to be coated below said bottom of said container;

passing said length into said opening of said container, through the upper surface of said thick cementitious mixture and through said thick cementitious mixture and out of the measured slit in the bottom of the container to produce a cementitious-laden mesh and passing said cementitious-laden mesh through an area of space between the measured slit and the panel and into contact with an upper surface of said panel;

moving said panel and said container with respect to each other while laying said cementitious-laden mesh onto said upper surface of said panel; and cutting off said cementitious-laden mesh below said measured slit to provide a coated panel having a wet cement layer on at least a portion of its upper surface and further having a reinforcing mesh therein.

2. A process for coating an upper surface of a panel with a mesh reinforced coating comprising the steps of:

placing a thick cementitious mixture in a container having a measured slit in the bottom thereof and an opening for the feeding of a length of mesh;

placing a source of mesh so that a length of the mesh can be fed into said container;

placing a panel to be coated below said bottom of said container;

passing said length into said opening of said container and through said thick cementitious mixture and out of the measured slit in the bottom of the container to produce a cementitious-laden mesh and passing said cementitious-laden mesh through an area of space between the measured slit and the panel and into contact with an upper surface of said panel;

moving said container over said panel, said panel being stationary during the moving of said container while laying said cementitious-laden mesh onto said upper surface of said panel; and cutting off said cementitious-laden mesh below said measured slit to provide a coated panel having a wet cement layer on at least a portion of its upper surface and further having a reinforcing mesh therein.

3. A process for coating an upper surface of a panel with a mesh reinforced coating comprising the steps of:

placing a thick cementitious mixture in a container having a measured slit in the bottom thereof and an opening for the feeding of a length of mesh;

placing a source of mesh so that a length of the mesh can be fed into said container;

placing a panel to be coated below said bottom of said container;

passing said length into said opening of said container, through an upper surface of said thick cementitious mixture and through said thick cementitious mixture and out of the measured slit in the bottom of the container to produce a cementitious-laden mesh and passing said cementitious-laden mesh through an area of space between the measured slit and the panel and into contact with an upper surface of said panel;

moving said container with respect to said panel while laying said cementitious-laden mesh onto said upper surface of said panel;

cutting off said cementitious-laden mesh below said measured slit to provide a coated panel having a wet cement layer on at least a portion of its upper surface and further having a reinforcing mesh therein; and wherein said coated panel is subjected to vibration to smooth an upper surface thereof.

* * * * *